United States Patent [19]

Kawahara

[11] Patent Number: 4,491,069

[45] Date of Patent: Jan. 1, 1985

[54] PRINTING HAMMER DRIVER MECHANISM

[75] Inventor: Hiroshi Kawahara, Nagoya, Japan

[73] Assignee: Brother Kogyo Kabushiki Kaisha, Nagoya, Japan

[21] Appl. No.: 509,935

[22] Filed: Jul. 1, 1983

[30] Foreign Application Priority Data

Jul. 13, 1982 [JP] Japan ..... 57-106477[U]

[51] Int. Cl.[3] ..... B41J 7/92

[52] U.S. Cl. ..... 101/93.03; 101/93.19; 400/157.3

[58] Field of Search ..... 101/93.03; 400/144.2, 400/157.3, 166

[56] References Cited

U.S. PATENT DOCUMENTS

| | | | |
|---|---|---|---|
| 3,229,798 | 1/1966 | Grashoff | 400/437 |
| 3,726,213 | 4/1973 | Herbert | 101/93.03 |
| 3,888,339 | 6/1975 | Nowak et al. | 400/157.3 |
| 4,348,121 | 9/1982 | Clavel | 400/166 |

FOREIGN PATENT DOCUMENTS

| | | | |
|---|---|---|---|
| 44659 | 4/1981 | Japan | 400/144.2 |
| 993833 | 6/1965 | United Kingdom | 101/93.48 |

OTHER PUBLICATIONS

IBM Technical Disclosure Bulletin, "Free Flight and Power Flight Adjustments" by Morgan et al., vol. 19, No. 4, p. 1323, 9-76.

*Primary Examiner*—Paul T. Sewell
*Assistant Examiner*—John A. Weresh
*Attorney, Agent, or Firm*—Moonray Kojima

[57] ABSTRACT

A printing hammer drive mechanism for a printing apparatus, comprising a manual control member movably attached to a main frame, an electromagnet mounted on the main frame for movement relative to the armature thereof, linking means disposed between the control member and the electromagnet for changing the gap between the core and the armature of the electromagnet in accordance with the operation of the control member, and a member for transmitting movement of the armature from a rest position to a work position, to a printing hammer, wherein the impact force of the hammer can be suitably changed by operating the control member to change the gap between the core and the armature of the electromagnet.

2 Claims, 5 Drawing Figures

PRINTING HAMMER DRIVER MECHANISM

BACKGROUND OF THE INVENTION

1. Field of the Invention

This invention relates to a printing hammer drive mechanism for a printing apparatus capable of printing letters, numbers and symbols by striking types arranged on a printing element, such as type wheel, with a printing hammer.

2. Description of Prior Art

A printing apparatus, often requires the change of printing pressure according to the number of copies desired. In a conventional printing apparatus, it usually the case that printing pressure is changed by changing the force of the spring normally holding the hammer in its rest position. However, the adjustment of printing pressure by adjusting the spring force does not produce accurate and correct amount of printing pressure in most cases.

SUMMARY OF THE INVENTION

The present invention provides an improved printing hammer drive mechanism capable of overcoming the above and other deficiencies and disadvantages of the conventional printing hammer drive mechanisms.

Accordingly, it is an object of the invention to provide a printing hammer drive mechanism for a printing apparatus, such as a typewriter, having a simple construction and capable of changing and setting accurate and correct printing pressure.

According to the invention, there is provided a printing hammer drive mechanism for a printing apparatus adapted to position a selected type arranged on a printing element opposite to a printing position and to print a letter, number or symbol represented by the selected type, by striking the type with a hammer through attraction of an armature of an electromagnet, from its rest position to a working position by energizing the electromagnet. The drive mechanism comprises a frame; a manual control member mounted movably on the frame; an electromagnet having a winding, a core and an armature, and mounted on the frame so that at least either the core or the armature is movable with respect to the other; linking mechanism disposed between the manual control member and the core or armature and adapted to move the core or the armature and adjust the gap between the core and armature in a rest position; and transmitting mechanism for transmitting the movement of the armature to the hammer and thereby move the hammer from a rest position to a work position and strike the selected type.

DETAILED DESCRIPTION OF THE PREFERRED EMBODIMENTS

Figure 1:
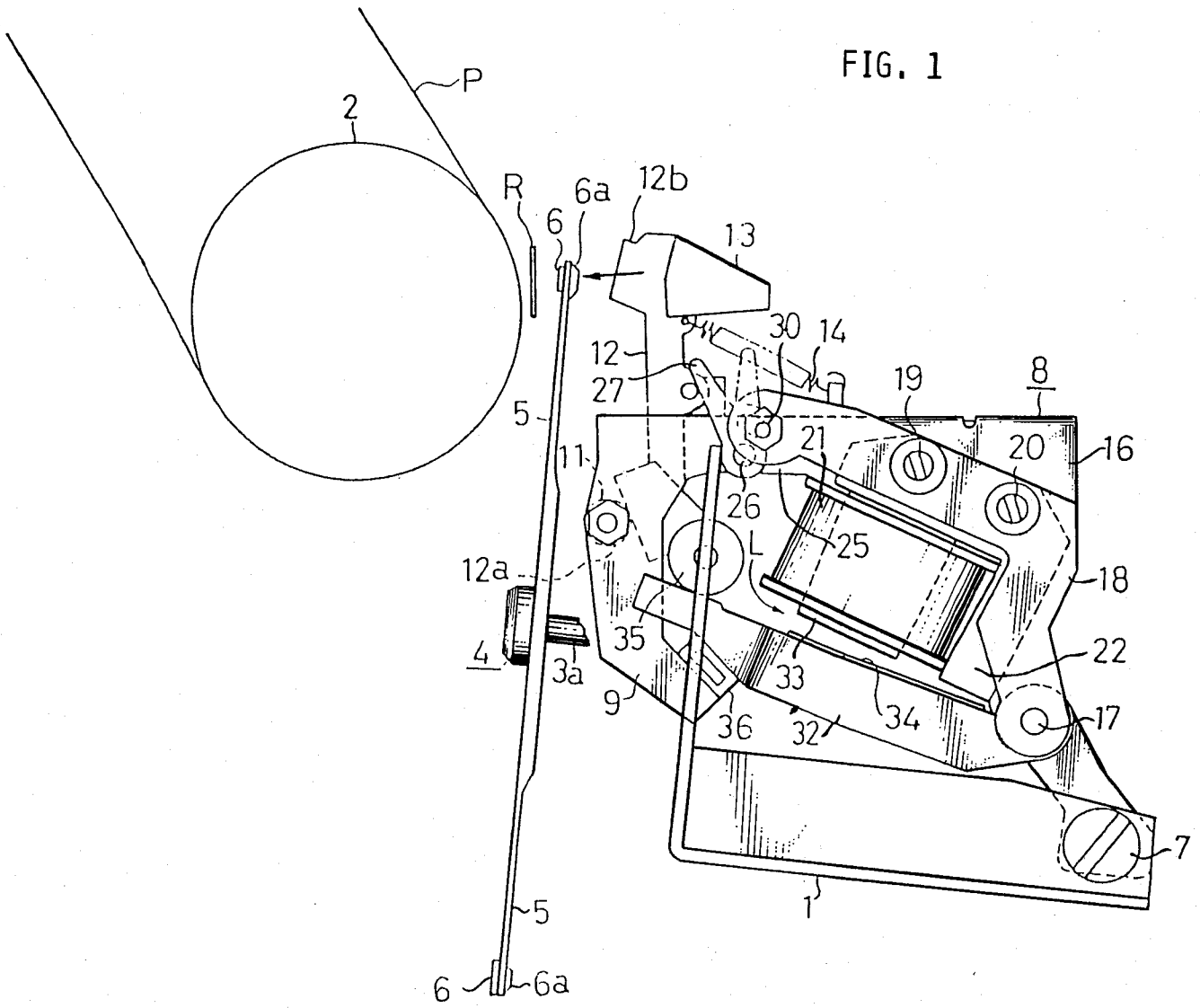
FIG. 1 is a side elevational view of an illustrative embodiment of the invention as used in a printing apparatus.
Figure 2:
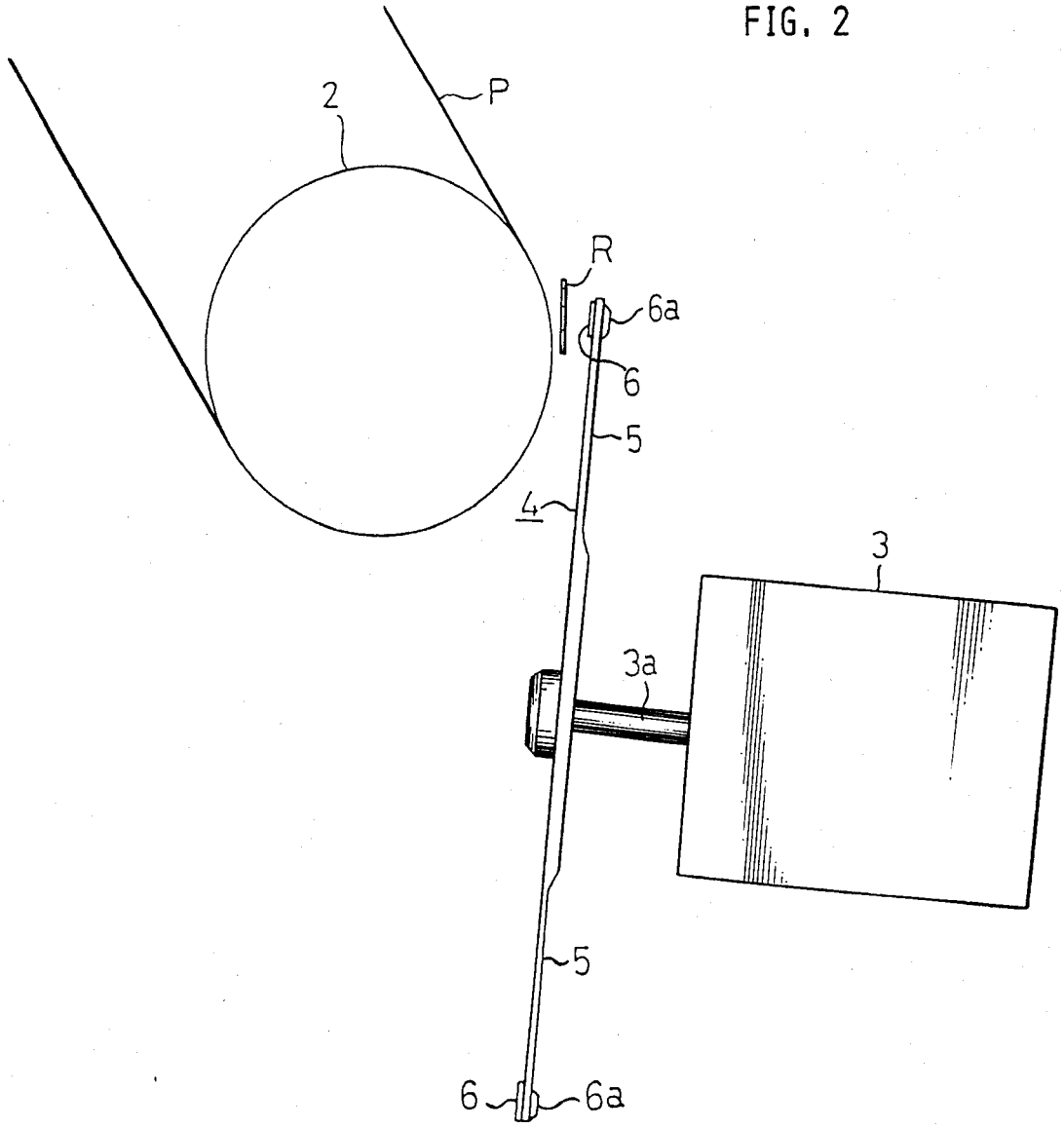
FIG. 2 is a side elevational view illustrating the positional relationship between the platen, typewheel and type selecting motor of the apparatus shown in FIG. 1.

Turning to FIG. 1, a platen 2 is supported rotatably on a frame 1 of a typewriter, for example. As shown in FIG. 2, a type selecting motor 3 is disposed in front of a platen 2, and is fixed to frame 1. A typewheel, which may be of the Daisy wheel type, is fixedly mounted on shaft 3*a* of motor 3. Type wheel 4 has a plurality of radially arranged arms 5 each provided at the extremities thereof with a type 6. Once a selected type key, not shown is depressed, type selecting motor 3 is rotated to selectively bring a type 6 on type wheel 4 corresponding to the selected type key to a position opposite the printing position on the platen 2.

Figure 3:
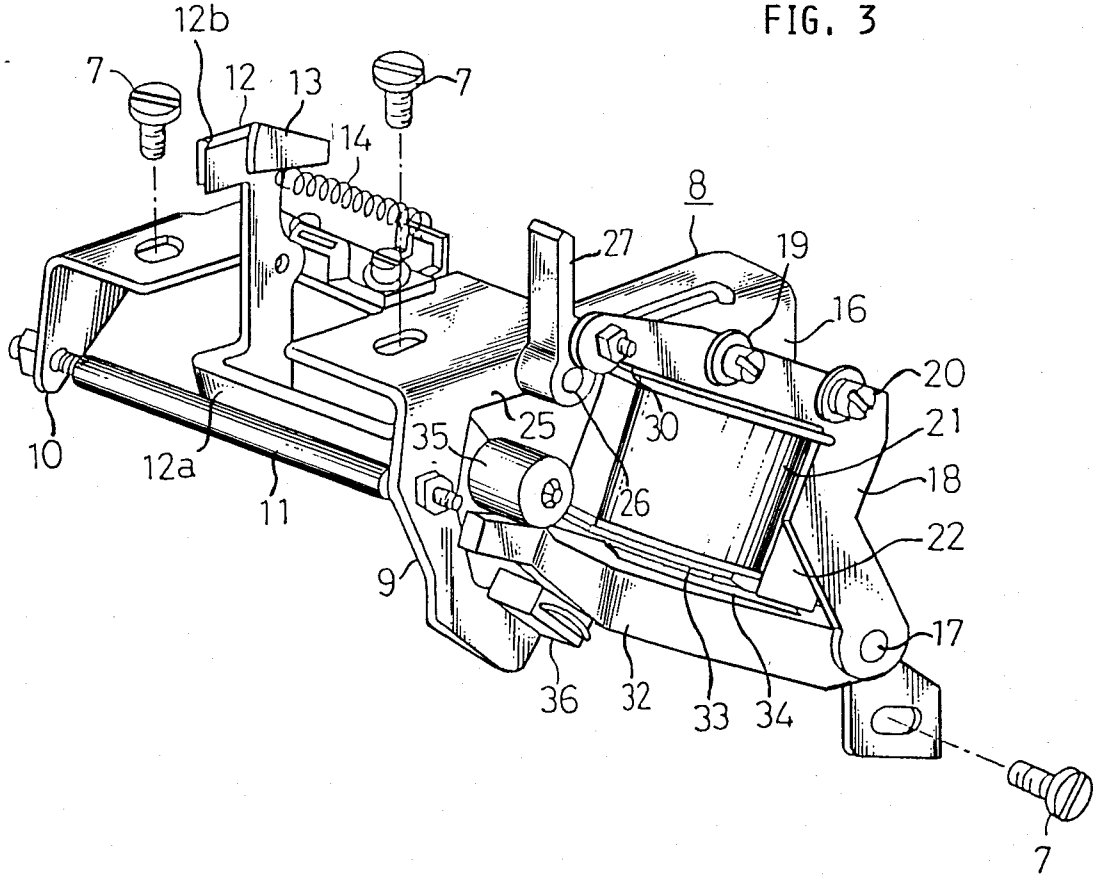
FIG. 3 is a perspective view of parts of the printing hammer drive mechanism according to the invention.

As shown in FIGS. 1 and 3, a hammer holder 8 is disposed above type selecting motor 3 and is fastened to frame 1 with three screws 7. The opposite ends of hammer holder 8 are bent to form support legs 9 and 10, for supporting a support shaft 11, rotatably therebetween. The foot 12*a* of a printing hammer 12 is fixed to the outer circumference of support shaft 11 so that printing hammer 12 is capable of striking the back 6*a* of type 6 positioned opposite to the printing position with printing hammer head 12*b* thereof. Head 12*b* of hammer 12 is provided fixedly with a weight 13 of a predtermined weight to provide an appropriate impact force to hammer 12 when it strikes a type.

A printing sheet P is appropriately guided by platen 2, and a ribbon R is used in connection with the printing operation and is disposed between the type and the platen, with paper P being disposed therebetween, all in the manner known in the art.

A spring 14 is extended between hammer 12 and hammer holder 8 to normally urge printing hammer 12 in a direction opposite to the striking direction. Thus, in a rest position, the hammer is normally held away from the type wheel. In a work position, against the force of the spring, hammer 12 is caused to strike the type by moving counterclockwise (in FIG. 1).

Figure 4:
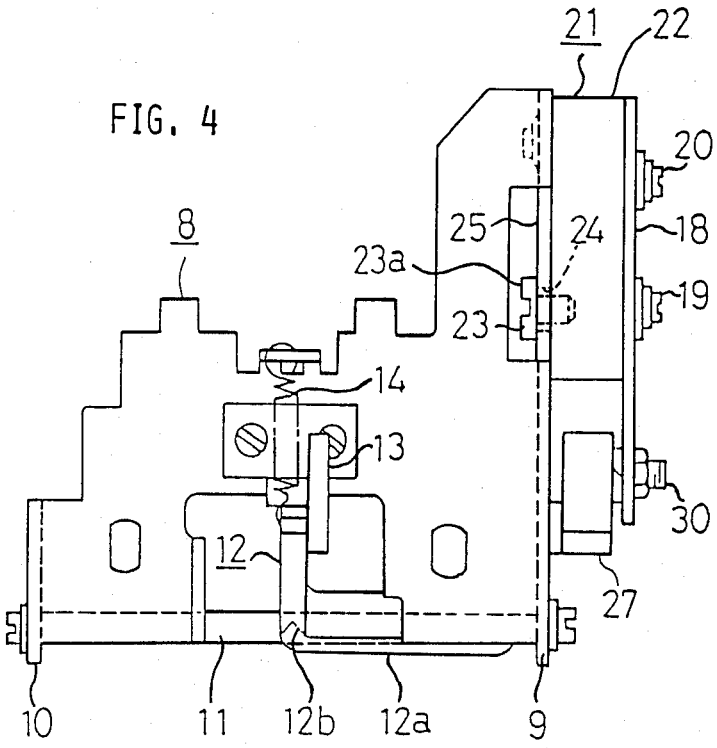
FIG. 4 is a plan view of a hammer holder.

A mounting plate 18 is supported rotatably by means of a shaft 17 on a supporting part 16 formed by bending the rear portion of hammer holder 8. The yoke 22 of an electromagnet 21, for driving printing hammer 12, is fastened to mounting plate 18 with two screws 19 and 20. As shown in FIG. 4, a screw 23 is inserted through a guide hole 24 formed through a rib 25 provided between support leg 9 and supporting part 16 of hammer holder 8 and is screwed in yoke 22. The head portion 23*a* of screw 23 is firmly pressed against rib 25 to apply a rotational resistance to mounting plate 18.

Figure 5:
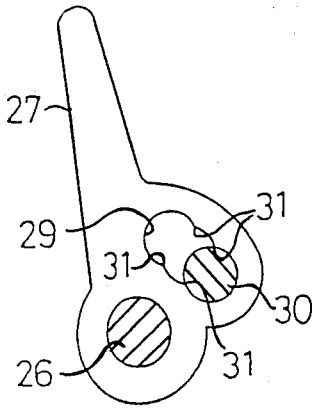
FIG. 5 is a side elevational view of a manual control lever.

A manual control lever 27, made for example of synthetic resin, is supported rotatably on rib 25 by means of a shaft 26 (see FIGS. 1 and 5). The upper end portion of manual control lever 27 is located beside the side wall of a ribbon cassette, not shown. Manual control lever 27 is operated when a cover, not shown, covering the ribbon cassette is opened. As shown in FIG. 5, a cam hole 29 is formed in manual control lever 27. A pin 30, fixed to the rear part of mounting plate 18, is fitted in cam hole 29 (see FIG. 4). As shown in FIG. 1, when manual control lever 27 is turned on shaft 26, cam hole 29, causes, through action of pin 30, mounting plate 18 to rotate about shaft 17 in a direction corresponing to the turning direction of manual control lever 27. Two pairs of small protrusions (see FIG. 5) are formed in the inside surface of cam hole 29 with each pair of small protrusions positioned opposite to each other. Small protrusions 31 engage pin 30 to retain manual control lever 27 at three different positions. Cam hole 29 and pine 30 constitute a linking mechanism for cooperatively linking manual control lever 27 and mounting plate 8.

A lever 32, for example of synthetic resin, is supported rotatably at a pivotal end thereof on shaft 17 (see FIG. 3). An armature of magnetic material 34 is attached to lever 32 and disposed opposite to core 33 and yoke 22 of magnet 21 (see FIGS 1 and 3). When energized, electromagnet 21 attracts armature 34 to core 33 so that lever 32 is turned clockwise (as viewed in FIG. 1) on shaft 17. A member, for example, a rubber roller 35, is attached to the lower end of foot 12*a* of printing hammer 12. The rubber roller is kept normally contiguous with the upper surface of the free end of lever 32 (see FIG. 1) by action of spring 14 urging hammer 12*b* toward its rest position, in the normal unenergized state of the electromagnet. Thus, rubber roller 35 urges lever 32 in a counterclockwise direction, that is, away from core 33. A stopper 36 (see FIG. 3) is provided on support leg so as to be in abutment with the lower surface of the free end of lever 32 to retain the lever 32 at its rest position whereat armature 34 is positioned opposite to core 33 with a small gap L therebetween. Stopper 36 and spring 14 define cooperatively a rest position of printing hammer 12.

When a type key is depressed, type selecting motor 3 rotates type wheel 4, to select a type corresponding to the depressed key, and then electromagnet 21 is energized to attract armature 34 to core 33. Consequently, hammer 12 is turned counterclockwise on support shaft 11 toward selected type 6 through action of rubber roller 35. Thus, head 12*b* of hammer 12 strikes back 6*a* of selected type 6 with a predetermined force of impact, to print a letter, number or symbol corresponding to the type 6.

Turning manual control lever 27 either counterclockwise or clockwise causes, through cam hole 29, pin 30, to approach or to move away from shaft 26 (see FIG. 5). Thus, mounting plate 18 is turned either counterclockwise or clockwise on shaft 17. Accordingly, gap L (See FIG. 1) between core 33 and armature 34 of lver 32, of electromagnet 21, is changed, and hence the stroke of lever 32 is changed, when electromagnet 21 is energized. Consequently, the energy of motion of hammer 12 is changed either to reduce or to increase the impact force of hammer 12. More specifically, when pin 30 is positioned in cam hole 29 at the right end position as illustrated in FIG. 5, gap L between core 33 and armature 34 of lever 32 is the narrowest. Hence the impact force of hammer 12 is the smallest at this position. When pin 30 is positioned at the left end position in cam hole 29, in FIG. 5, gap L is the widest. Hence, in that position, the impact force of hammer 12 is the largest. When pin 30 is positioned at a middle position in cam hole 29 in FIG. 5, the impact force of hammer 12 would have a value between the largest and smallest.

Although the present invention has been described in its preferred form with a certain degree of particularity, it is understood that the present invention is not limited to the above mentioned preferred embodiment, but changes or modifications in the details of construction and the combination and arrangement of parts may be made without departing from the spirit and scope of the invention. For example, the small gap L may be changed by moving only armature 32 or both armature 32 and core 32.

What is claimed is:

1. In a printing apparatus comprising a frame, a printing element having a plurality of types thereon, a printing hammer, and a hammer driving mechanism for driving said hammer to strike a selected type positioned opposite a printing position, thereby to print said type; the improvement comprising said hammer driving mechanism comprising, in combination, an electromagnet having a core and yoke;

an armature disposed opposite to said core;

a mounting plate rotatably supported on said frame;

said electromagnet fixed to said mounting plate and said armature rotatably supported on said frame, said armature and said core having a gap therebetween in a rest position and having no gap in a work position;

manual control lever movably disposed on said frame;

link means disposed between said control lever and said mounting plate, and under the manual operation of said control lever for determining the amount of said gap between said core and said armature, at said rest position;

said link means consisting of a cam hole formed in said control lever, with at least two positions and a pin fixed to said mounting plate, and said pin movably fitted in said cam hole so as to be disposed in any of said at least two positions upon an operation of said manual control lever for varying the position of said electromagnet and thereby the amount of said gap between said core and said armature; and transmitting means disposed movably against said armature and connected to said hammer, for transmitting movement of said armature to said hammer whereby the amount of said gap between said core and said armature is controlled by the position of said control lever and determines the striking force of said hammer; and whereby upon energization of said electromagnet, said armature is moved from said rest position to said work position, and said transmitting means transmits the resulting movement to cause said hammer to move from said rest position to said work position and thereby strike said type, the rest position of said hammer being independent of the amount of said gap.

2. The mechanism of claim 1, wherein said transmitting means comprises a rubber roller attached to said printing hammer and in continuous movable contact with said armature.

* * * * *